US010337276B2

(12) United States Patent
Powell

(10) Patent No.: US 10,337,276 B2
(45) Date of Patent: Jul. 2, 2019

(54) WELL TUBE AND A WELL BORE COMPONENT

(71) Applicant: AKER SOLUTIONS AS, Lysaker (NO)

(72) Inventor: Joshua Powell, Friendswood, TX (US)

(73) Assignee: AKER SOLUTIONS AS, Lysaker (NO)

( * ) Notice: Subject to any disclaimer, the term of this patent is extended or adjusted under 35 U.S.C. 154(b) by 0 days.

(21) Appl. No.: 15/580,278

(22) PCT Filed: Jun. 9, 2016

(86) PCT No.: PCT/EP2016/063231

§ 371 (c)(1),
(2) Date: Dec. 7, 2017

(87) PCT Pub. No.: WO2016/198557

PCT Pub. Date: Dec. 15, 2016

(65) Prior Publication Data

US 2018/0163499 A1 Jun. 14, 2018

Related U.S. Application Data

(60) Provisional application No. 62/172,964, filed on Jun. 9, 2015.

(51) Int. Cl.

| | |
|---|---|
| ***E21B 23/01*** | (2006.01) |
| ***E21B 33/035*** | (2006.01) |
| ***E21B 33/043*** | (2006.01) |
| ***E21B 33/12*** | (2006.01) |
| ***E21B 43/12*** | (2006.01) |

(52) U.S. Cl.

CPC ..... *E21B 33/043* (2013.01); *E21B 23/01* (2013.01); *E21B 33/035* (2013.01); *E21B 33/12* (2013.01); *E21B 43/128* (2013.01)

(58) Field of Classification Search

CPC ..... E21B 23/01; E21B 33/035; E21B 33/043; E21B 33/076; E21B 33/12; E21B 43/128

See application file for complete search history.

(56) References Cited

U.S. PATENT DOCUMENTS

| | | | | |
|---|---|---|---|---|
| 6,776,230 | B2 * | 8/2004 | Collie | E21B 33/043 166/337 |
| 8,322,432 | B2 * | 12/2012 | Bailey | E21B 33/085 166/338 |
| 9,593,561 | B2 * | 3/2017 | Xiao | E21B 43/12 |
| 9,631,438 | B2 * | 4/2017 | McKay | E21B 33/035 |
| 9,702,212 | B2 * | 7/2017 | Breda | E21B 33/035 |
| 2008/0245534 | A1 | 10/2008 | Purkis | |
| 2011/0300008 | A1 * | 12/2011 | Fielder | E21B 19/002 417/410.3 |

(Continued)

*Primary Examiner* — Matthew R Buck
(74) *Attorney, Agent, or Firm* — Norman B. Thot

(57) ABSTRACT

A well tube configured for use with a subsea well assembly which includes a Christmas tree arranged on top of a subterranean well. The well tube includes a bore, a lockable insert arranged within the bore, and a locking assembly. The locking assembly includes a locking dog which moves into and out of a locking position, an actuator which moves the locking dog, and a control channel which couples the actuator to an exterior of the well tube and controls the actuator to move the locking dog to removably lock the lockable insert within the bore.

15 Claims, 14 Drawing Sheets

(56) References Cited

U.S. PATENT DOCUMENTS

| | | | | |
|---|---|---|---|---|
| 2012/0012341 | A1* | 1/2012 | White | E21B 33/03 166/386 |
| 2012/0013133 | A1* | 1/2012 | Rios, III | E21B 33/038 292/159 |
| 2013/0075103 | A1* | 3/2013 | Herbel | E21B 33/043 166/339 |
| 2014/0048277 | A1* | 2/2014 | June | E21B 33/035 166/348 |

* cited by examiner

A

B

WELL TUBE AND A WELL BORE COMPONENT

CROSS REFERENCE TO PRIOR APPLICATIONS

This application is a U.S. National Phase application under 35 U.S.C. § 371 of International Application No. PCT/EP2016/063231, filed on Jun. 9, 2016, and which claims benefit to U.S. provisional patent application No. 62/172,964, filed on Jun. 9, 2015. The International Application was published in English on Dec. 15, 2016 as WO 2016/198557 A1 under PCT Article 21(2).

FIELD

The present invention relates to a well tube of the type used with subterranean wells, for instance, a subsea well. The well tube is in particular provided with a locking assembly configured to lock a well bore component within its bore. The present invention further relates to a well bore component which is designed for being locked into such a bore. Also disclosed is a method of installing such a well bore component.

BACKGROUND

Many components used for subterranean wells, such as wells for production of oil or gas or injection wells, have the basic form of tubulars with bores. Due to pressure handling and safe production, such bores must be able to be opened and closed, for example, with valves or plugs.

Many plugs are known and commercially available which can be run and locked into a well tubular so that it seals off the bore. Such plugs are typically run with a running tool which positions the plug in a plug receiving space of a bore, and then activates a locking mechanism which is integrated in the plug itself. The running tool thus has means for locking to the plug itself, and also means for operating the plug locking mechanism.

This can be a satisfactory solution for plugs where the sole technical object is to seal off a bore. However, many plugs, as well as other well bore components, contain other technical features beyond merely sealing off the bore. Indeed, as well technology matures, more technical functions may be embedded into such well bore components. Some well bore components may be installed for other technical purposes other than sealing off the bore.

Such technical functions in a well bore component requires space. Space consuming functionality can, for instance, be feedthroughs within a plug. One may, for example, need a large diameter feedthrough for supplying sufficient power to the pump when suspending an electrical submersible pump (ESP) from a plug locked in a production bore. One may also want to arrange other lines, such as control lines, through the plug, or even a through bore. The available size of the well tubular bore restricts the possible size and number of functions embedded in the plug.

In some cases, the well bore component can be a tubing hanger, installed within or below a Xmas tree. One then wants to maintain a large production bore through the tubing hanger while simultaneously embedding various functions within the tubing hanger body. As with a well plug, the available space within the tubing hanger body is partially governed by the space used for locking the tubing hanger in the wellhead assembly.

SUMMARY

An aspect of the present invention is to provide a well bore component that offers an increased space for functions in addition to the mere locking of the component within the bore.

In an embodiment, the present invention provides a well tube configured for use with a subsea well assembly which comprises a Christmas tree arranged on top of a subterranean well. The well tube includes a bore, a lockable insert arranged within the bore, and a locking assembly. The locking assembly comprises a locking dog configured to move into and out of a locking position, an actuator configured to move the locking dog, and a control channel configured to couple the actuator to an exterior of the well tube and to control the actuator so as to move the locking dog to removably lock the lockable insert within the bore.

DETAILED DESCRIPTION

Figure 1:
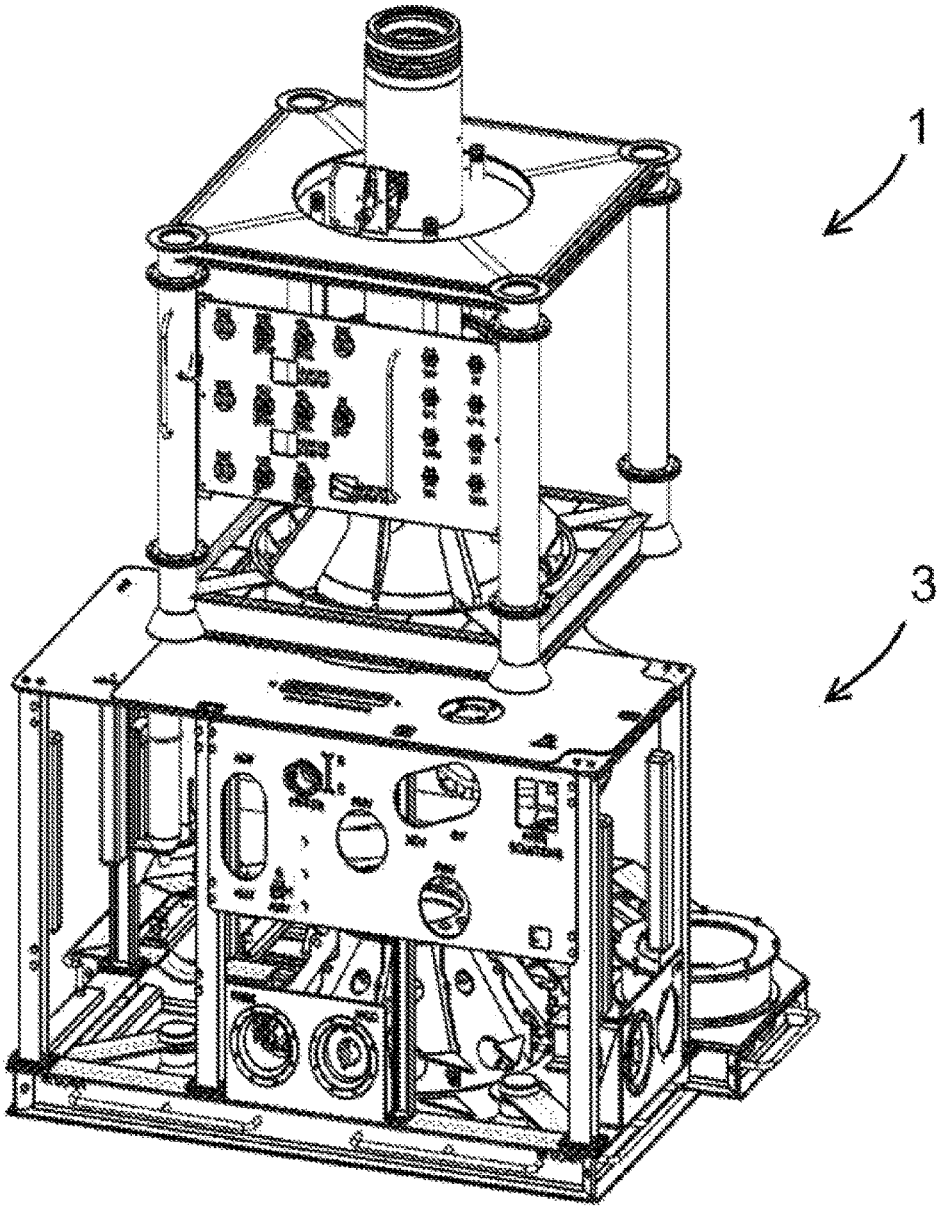
FIG. 1 is a perspective view of an adapter spool landed on top of a subsea Xmas tree.

A first aspect of the present invention provides a well tube configured for use with a subsea well assembly having a Xmas tree on top of a subterranean well. The well tube comprises a bore, and a locking assembly having:

- a locking dog configured to move into and out of a locking position;
- an actuator, such as a mechanical actuator, configured to move the locking dog; and a control channel coupling the actuator to an exterior of the well tube and configured to control the actuator to move the locking dog to removably lock a lockable insert within the bore.

The control channel may advantageously extend inside a wall portion of the well tube, i.e., between the inner surface of the bore and an outer surface of the well tube.

The locking dog and the actuator can be configured so that the actuator positions the locking dog at an outer radial position in an unlocked configuration and at an inner radial position in a locked configuration.

The actuator can be configured to move in a longitudinal direction with respect to the bore when changing from an unlocked position to a locked position, wherein the actuator remains positioned at substantially the same radial distance from a center of the bore, such as when moving the locking dog between an inner radial position and an outer radial position.

The bore may also extend between an upper bore end and a lower bore end, wherein the locking dog and the actuator can be arranged in a position between the upper bore end and the lower bore end.

The actuator may in some embodiments comprise an electric actuator, such as a screw drive, an electromagnetic actuator, or a piezoelectric actuator.

Alternatively or in addition, the control channel can advantageously comprise a hydraulic channel.

The well tube according to the first aspect of the invention may include a Xmas tree. This may, for example, be a horizontal tree or a vertical tree.

The well tube may include a spool, in particular a tubing head spool, a wellhead spool, or an adapter spool having a lower interface configured to lock on an upper interface of a Xmas tree.

The well tube may also include a tubing hanger, such as a production tubing hanger which is configured to suspend a tubing, in particular a production tubing, in a subterranean well.

The locking assembly can be arranged at a tubing hanger receiving space within the bore, at a plug receiving space within the bore, or at an internal tree cap receiving space within the bore.

The locking dog can be configured to move radially and at least a portion of the actuator can be configured to move axially.

The locking dog can also be configured to move radially and at least a portion of the actuator can be configured to move radially.

The actuator may comprise and/or connect to a hydraulic piston. Such a piston can be controlled by supply of pressurized hydraulic liquid.

The well tube may in some embodiments comprise:

a first locking assembly having:

a first locking dog configured to move into and out of the bore;

a first actuator configured to move the first locking dog; and a first control channel coupling the first actuator to an exterior of the well tube and configured to control the first actuator to move the first locking dog; and a second locking assembly having:

a second locking dog configured to move into and out of the bore;

a second actuator configured to move the second locking dog; and a second control channel coupling the second actuator to an exterior of the well tube and configured to control the second actuator to move the second locking dog.

Such a well tube may further comprise at least one coupling and/or spacer configured to be interposed between the first and second locking assembly. The bore may also comprise a shoulder configured to support the coupling and/or spacer.

The well tube according to the first aspect of the present invention may further comprise a lockable well bore insert configured to be locked into the bore and comprising:

an insert body, which may have an access distance that is at least 70% of an inner diameter of the bore; and a fixed recess into an outer surface of the insert body, such as a surface facing the bore.

The insert body may comprise a plug configured to seal the bore in such an embodiment.

In such an embodiment, the insert body may also comprise an inner bore having an outer diameter that is at least 60%, in particular at least 70%, in particular at least 80%, of an inner diameter of the well tube bore.

In such embodiments, the well tube may further comprise at least one penetrator through the insert body, the penetrator being configured to provide for at least one of electrical, electronic, fluidic, acoustic, magnetic, optical, and mechanical communication between a first surface of the insert, in particular a top, and an opposing surface of the insert, in particular a bottom.

In such an embodiment, the insert may comprise a plug and the penetrator may include a power cable interface configured to connect to a power cable configured to suspend and/or provide power to an electrical submersible pump.

The pump may be an electrical submersible pump coupled to the plug via the power cable interface.

Such a pump can typically be positioned within a subterranean well. In other embodiments, the submersible pump can be a hydraulic pump powered through a hydraulic power cable.

Also disclosed is a hydrocarbon production assembly comprising:

a Christmas tree, such as a subsea Christmas tree; and a well tube as discussed above, which may comprise an adapter spool landed on the Christmas tree.

Such an assembly may further comprise a lockable well bore insert of one of the types which will be discussed below.

The assembly may also further comprise:

an electrical penetrator through the lockable well bore insert;

a pump power cable connected to the electrical penetrator; and an electrical submersible pump coupled to the lockable well bore insert via the pump power cable.

A second aspect of the present invention provides a lockable well bore insert configured to be locked in a bore of a well tube configured for use with a subsea well assembly having a Xmas tree, the lockable well bore insert comprising:

an insert body; and a fixed locking recess into an outer surface of the body, in particular a surface facing radially outward toward an inner surface of the bore.

Such a lockable well bore insert may further comprise a bore sealing apparatus configured to seal the insert against the bore.

The lockable well bore insert can also comprise an electrical penetrator which is configured to connect to a pump power cable, such as with a power cable interface.

In such an embodiment, the lockable well bore insert can be coupled to a pump power cable and an electrical submersible pump coupled to the insert via the pump power cable.

The well bore component can also include a tubing hanger, a plug, or an internal tree cap.

The well bore component may also include a production tubing hanger comprising an inner production bore having a locking assembly configured to lock another well bore component.

In such an embodiment, the production tubing hanger may further comprise an annulus bore having a locking assembly configured to lock an annulus bore plug. An annulus isolation valve or a plug setting and locking device for sealing the annulus bore is/are therefore not needed because the locking assembly can be provided within the annulus bore.

The lockable well bore insert of the above types may further comprise a feedthrough extending from an upper interface to a lower interface, such as a feedthrough comprising mechanical penetrator, a hydraulic penetrator, an electrical penetrator, an optical penetrator, or a communications penetrator.

A well bore component as discussed herein may comprise the lockable well bore insert as also discussed herein, which may further comprise:

- an upper main body having:
  - a first outer diameter;
  - a first access distance;
  - a first recess into a surface of the upper main body; and
- a lower main body having:
  - a second outer diameter, particularly the same as the first outer diameter;
  - a second access distance; and
  - a second recess into a surface of the lower main body.

The upper main body and the lower main body may both be provided with a sealing apparatus in such a well bore component. Notably, with such a well bore component, the operator may provide a double barrier in a well tube in one single run.

In such embodiments, the upper main body can be coupled to the lower main body with an intermediate coupling. The intermediate coupling can provide for independent movement of the upper main body with respect to the lower main body, in particular an axial movement, in particular a longitudinal movement. The upper and the lower body can thereby be coupled together, however, in such a manner that they may move with respect to each other. This feature may be relevant when using the component for providing a double barrier because sealing apparatuses on the respective main bodies should be able to adapt to the facing sealing surfaces of the bore against which they seal.

A third aspect of the present invention provides a locking tube which is configured to removably lock a lockable insert. The locking tube comprises a tube body having a bore and:

- a movable dog shaped to fit a corresponding recess in the lockable insert;
- an actuator, in particular at least one of an electric actuator, a hydraulic actuator, a magnetic actuator, and a mechanical actuator, which is configured to couple the dog to the tube body and actuate the dog into and out of the bore; and
- a control channel, in particular at least one of an electrical channel, an optical channel, a magnetic channel, and a hydraulic channel, which is configured to couple the actuator to an exterior of the body and control the actuator to actuate the dog.

The dog for such a locking tube may be configured to move radially inward to lock the lockable insert and radially outward to unlock the lockable insert.

The control channel may also couple to the exterior via at least one of a side, a top, and a bottom of the tube body.

In some embodiments, the locking tube can be integrated into at least one of a Christmas tree, a wellhead, a spool, in particular an adapter spool, a tubing spool, and a tubing hanger, in particular a production tubing hanger.

Such a tubing hanger can be configured to inject and/or extract fluids into and/or from a subterranean reservoir, in particular a subsea reservoir.

The locking tube may in some embodiments further comprise at least two movable dogs located at different longitudinal distances along the tube, in particular wherein a first dog at a first distance is coupled to and actuated by a first actuator, and a second dog at a second distance is couple to and actuated by a second actuator.

The present invention also provides a locking apparatus, in particular an apparatus configured to provide an ISO-13628-4 compliant double-barrier, comprising:

- the locking tube discussed above;
- a first lockable insert;
- a second lockable insert; and
- a coupling configured to couple and locate the first and second lockable inserts so that:
  - a first recess in the first lockable insert aligns with the first dog, and
  - a second recess in the second lockable insert aligns with the second dog.

The present invention also provides a lockable insert which is configured to be removably locked by a locking tube, the lockable insert comprising an insert body having:

- an outer diameter;
- an access distance; and
- a recess into a surface of the insert body, in particular a surface facing radially outward and shaped to receive a corresponding dog of the locking tube, wherein the access distance can be at least 70%, at least 80%, or at least 90% of an outer diameter of the lockable insert.

Such a lockable insert can comprise a plug which is configured to seal an interior of the tube body from an exterior of the tube body when locked into the locking tube.

In some embodiments, the access distance can include an open bore through the insert, for example, an open bore having a bore diameter that is at least 70%, at least 80%, or at least 90% of an outer diameter of the lockable insert.

The access distance can include a penetrator through the insert, in particular at least one of an electrical penetrator, hydraulic penetrator, mechanical penetrator, and an optical penetrator.

The lockable insert may in some embodiments be coupled to an electrical submersible pump.

The lockable insert may also comprise:

- a first cross sectional area of the entire locking insert, including a portion of the first cross sectional area devoted to locking functionality; and
- an access area, such as a circular area, describing an area through which opposing faces of the insert may be accessed, the access area can be greater than 60%, greater than 70%, greater than 80%, or even greater than 90% of the first cross sectional area.

For such a lockable insert, the access area may comprise a plurality of concave and convex curvatures.

The lockable insert can further comprise:

a movable dog shaped to fit a corresponding recess in an inner lockable insert;

an actuator, in particular at least one of an electric actuator, a hydraulic actuator, a magnetic actuator, and a mechanical actuator, which is configured to couple the dog to the body and actuate the dog; and a control channel, in particular at least one of an electrical channel, an optical channel, a magnetic channel, and a hydraulic channel, which is configured to couple the actuator to an exterior of the body and control the actuator to actuate the dog.

Also disclosed is a locking apparatus comprising:

a locking tube according to one of the locking tubes discussed above and having an inner diameter; and a corresponding lockable insert according to one of the types discussed above, which is sized to fit within the inner diameter of the locking tube.

For such a locking apparatus, the access distance of the lockable insert can be at least 70%, at least 80%, or at least 90% of the inner diameter of the locking tube.

Also disclosed is a method of installing a well bore component in a bore of a well tube coupled to a subsea wellhead assembly having a Christmas tree. The method comprises:

inserting the well bore component into the bore;

communicating a locking signal through a control channel extending through a bore wall of the well tube; and instructing an actuator with the locking signal to lock a movable dog into the inserted well bore component.

For such a method, the actuator may in some embodiments include a hydraulic piston, and the locking signal can include a hydraulic pressure engaging the hydraulic piston.

In such a method, the well bore component can also be connected to a submersible pump via a power cable.

In some embodiments of such a method:

the well bore component can comprise first and second well plugs which are coupled via a coupling and which are configured to cooperate with first and second locking assemblies, and instructing the actuator can comprise:

instructing a first actuator to lock a first movable dog coupled to the first well plug; and instructing a second actuator to lock a second movable dog coupled to the second well plug, in particular comprising locking the two well plugs within the well tube bore in a single step, such as a single trip from a surface vessel.

The locking tube discussed above may further comprise:

an unlock actuator configured to unlock at least one dog, such as in the event of a failure of the actuator coupled to the dog; and an unlock channel configured to activate the unlock actuator to unlock the dog.

Also disclosed is a subsea well plug assembly comprising an upper plug and a lower plug, a plug running tool interface above the upper plug and an intermediate portion between the upper plug and the lower plug. The intermediate portion connects the upper plug to the lower plug, wherein the upper plug and the lower plug each comprises a locking profile adapted to engage with a locking device.

Also disclosed is a subsea spool having a spool bore which is adapted to receive a spool bore component having a locking profile, wherein the subsea spool is provided with a locking assembly adapted to engage the locking profile.

Some detailed and non-limiting examples of embodiments of the present invention are presented below under reference to the drawings.

Figure 2:
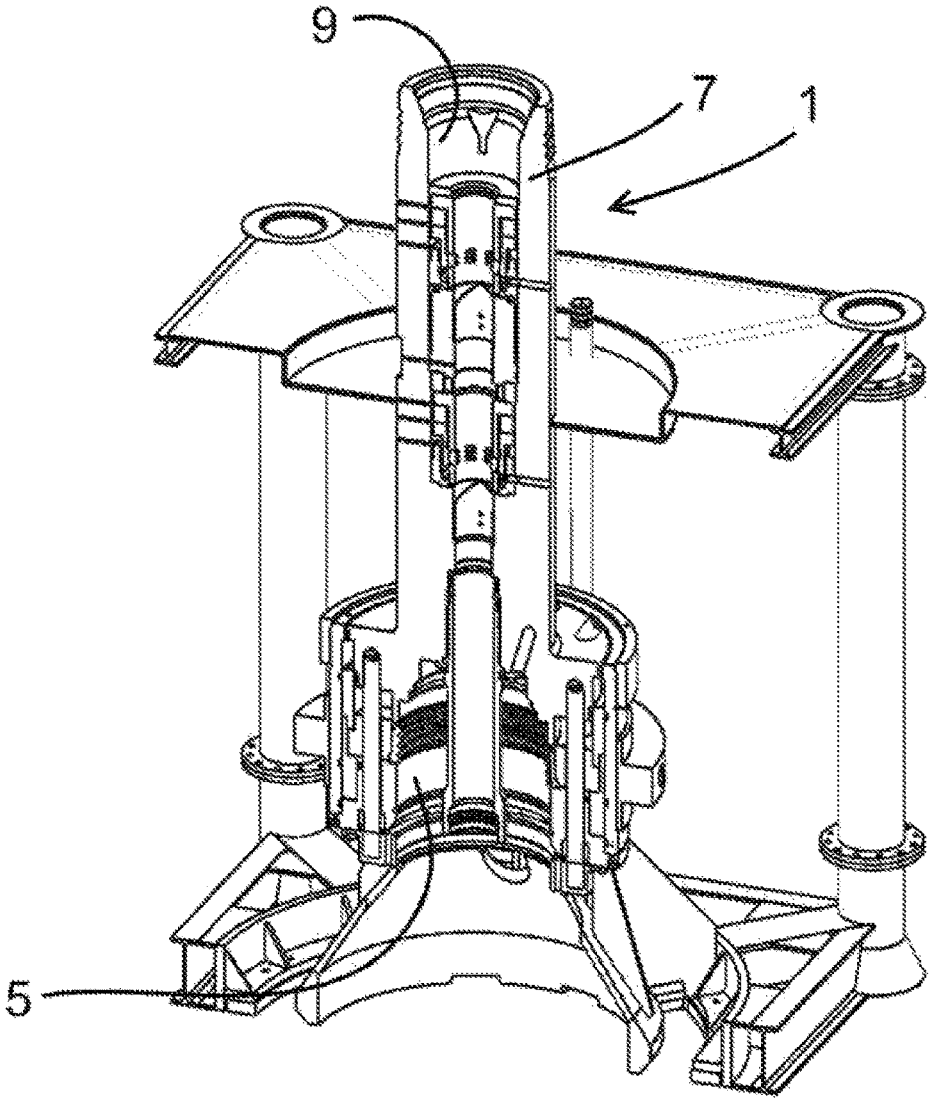
FIG. 2 is a cross section perspective view of the adapter spool shown in FIG. 1.

FIG. 1 is a perspective view of an adapter spool 1 arranged on top of a subsea Xmas tree 3. The adapter spool 1 has a lower interface 5 adapted to lock onto the upper profile of the Xmas tree 3, as indicated on the perspective cross section view of FIG. 2. On top of the adapter spool 1 there is an upper interface 7, which resembles or is identical to the upper profile of the Xmas tree 3. The spool adapter 1 is thus suited for being installed between the Xmas tree 3 and equipment that normally is landed on the Xmas tree 3, such as a lower riser package (LRP) and an emergency disconnection package (EDP). The adapter spool 1 further has a spool bore 9.

Figure 3:
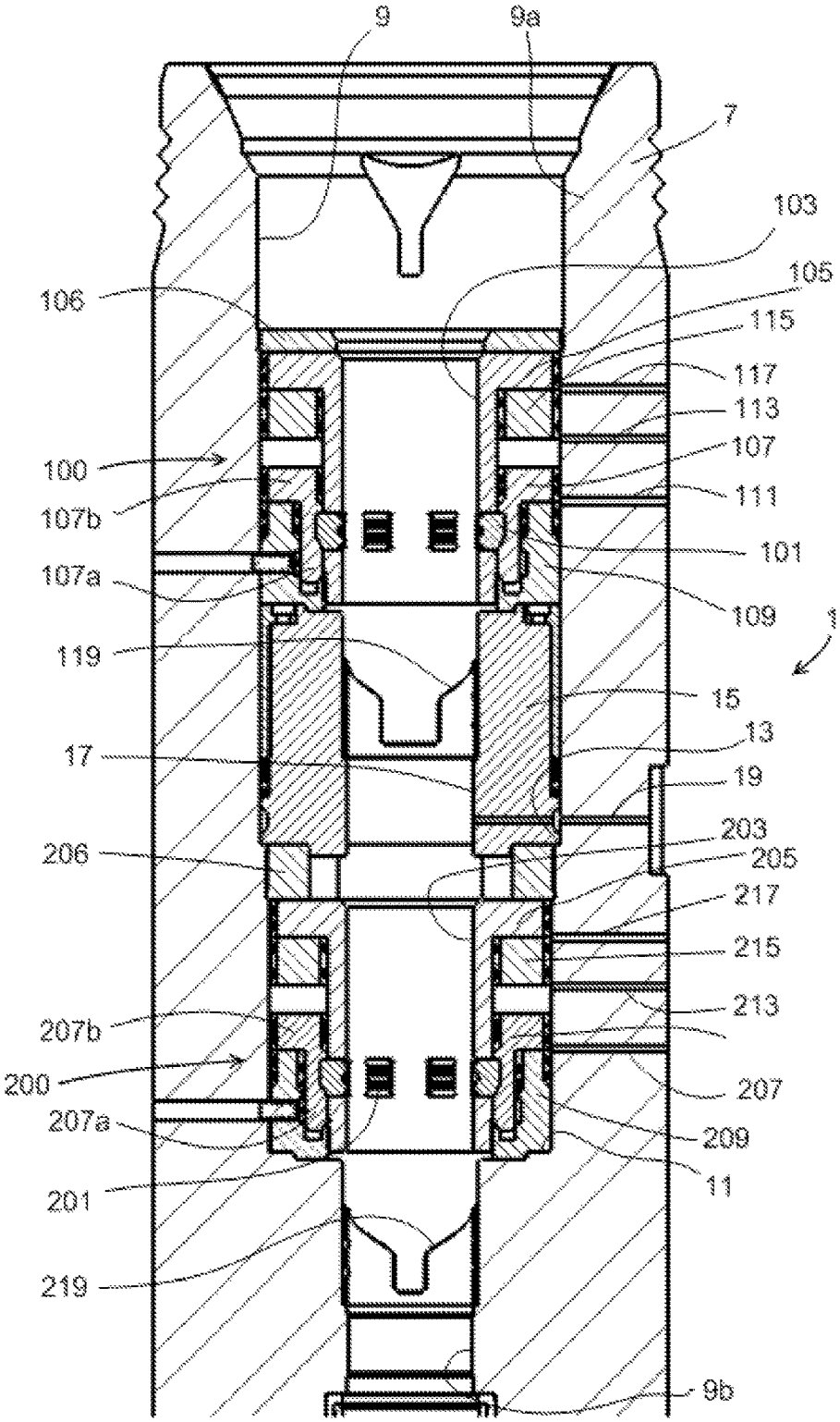
FIG. 3 is a cross section side view through a portion of the adapter spool illustrating two locking assemblies.

FIG. 3 is a cross section view through the upper portion of the adapter spool 1. Within the spool bore 9 there is arranged a first locking assembly 100 and a second locking assembly 200. In this embodiment, the locking assemblies 100, 200 are adapted to lock plugs within the spool bore 9. Such plugs will be discussed further below.

Within the spool bore 9 having an upper bore end 9*a* and a lower bore end 9*b* there is a lower shoulder 11 and an upper shoulder 13. The second locking assembly 200 rests within the spool bore 9 on the lower shoulder 11. A spacer 15 having a spacer bore 17 rests on the upper shoulder 13. The first locking assembly 100 rests on an upper surface of the spacer 15.

As the first and second locking assemblies 100, 200 are in principle alike, only the function and components of the first locking assembly 100 will be discussed below. A set of locking dogs 101 are distributed circumferentially about a central bore 103 of a locking assembly sleeve 105. The locking dogs 101 are supported in apertures in the locking assembly sleeve 105 and are adapted to be moved radially inwards and outwards via engagement with an axially movable actuation sleeve 107. The locking dogs 101 are shown in their retracted, unlocked position in FIG. 3.

The locking assembly sleeve 105 is prevented from moving upwards by a threaded lock ring 106, which engages a threaded portion of the spool bore 9.

The actuation sleeve 107 has a sleeve portion 107*a* positioned between the locking assembly sleeve 105 and a main body 109. The actuation sleeve 107 further has a collar 107*b* extending radially outwards from the upper portion of the sleeve portion 107*a*. By applying pressurized hydraulic fluid to a hydraulic locking channel 111 through the wall of the adapter spool 1, the actuation sleeve 107 is forced upwards, causing the locking dogs 101 to move radially inwards into their locking position (compare the second locking assembly 200 of FIG. 3 which illustrates the locking position). The hydraulic fluid enters a volume between the main body 109 and the collar 107*b* of the actuation sleeve 107. The collar 107*b* therefore functions as a hydraulic piston.

To move the actuation sleeve 107 in the opposite, unlocking direction, hydraulic fluid is supplied through a hydraulic unlocking channel 113. The hydraulic pressure will force the actuation sleeve 107 down, into the position shown in FIG. 3, thereby making the locking dogs 101 able to retract.

For redundancy, there is also arranged a secondary unlocking piston 115 which is actuated by supply of hydraulic fluid through a secondary unlocking channel 117. Similar components are included in the second locking assembly 200, indicated with reference numbers in the 200-series.

Also arranged in the wall of the adapter spool 1 is a test port 19 which enables a pressure test within the bore 9 of the adapter spool 1. For example, if an upper and a lower plug are installed and should seal be within the bore 9 at the position of the first and second locking assemblies 100, 200, the sealing capability can be tested by application of pressurized hydraulic fluid through the test port 19.

Figure 4:
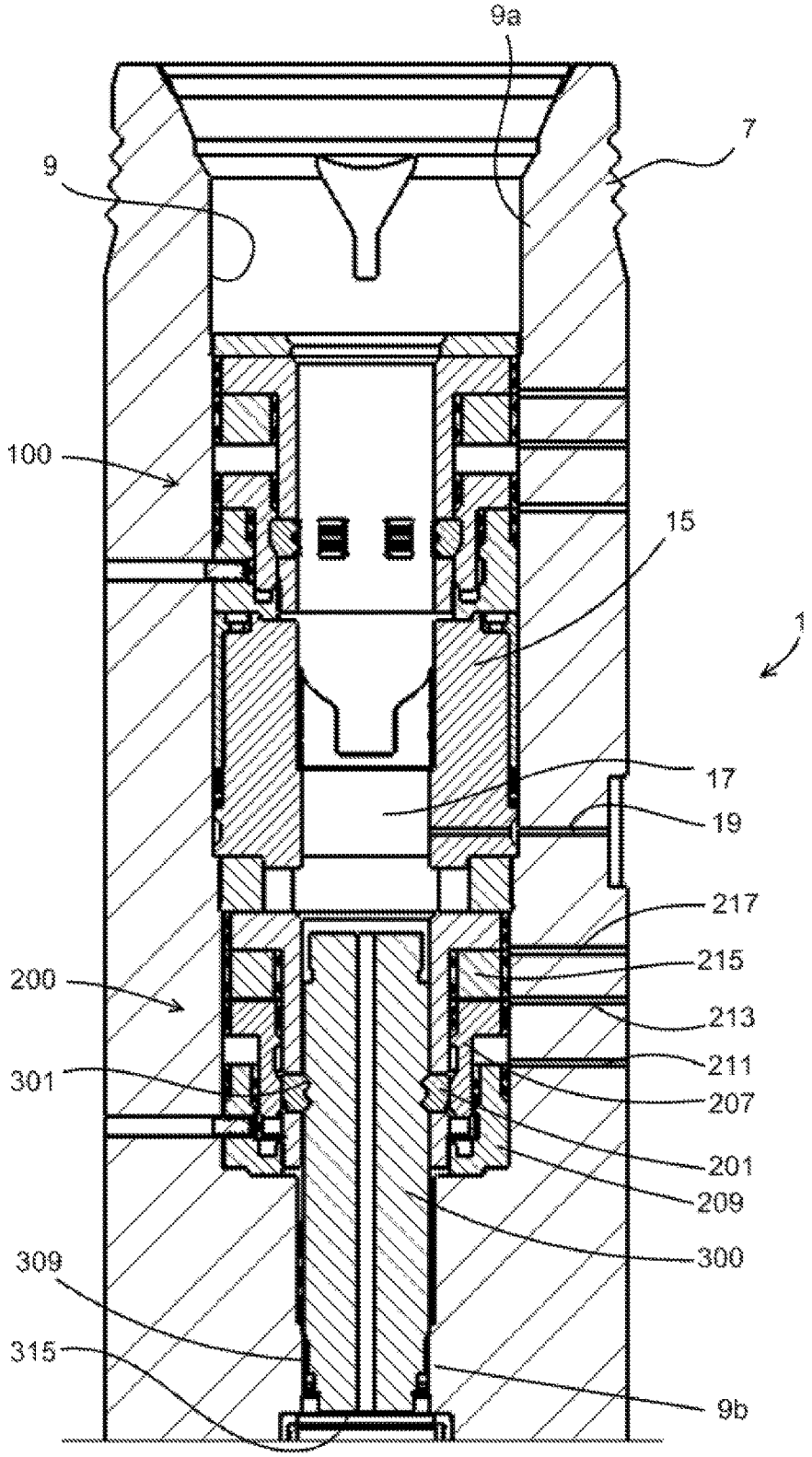
FIG. 4 is a cross section side view corresponding to FIG. 3, however, with a plug installed.

FIG. 4 is a cross section view through the adapter spool 1, corresponding to FIG. 3. However, in FIG. 4, a plug 300 is locked within the spool bore 9 via the second locking assembly 200. The plug 300 is provided with a locking recess, here in the form of a locking profile 301, on its outer surface. As shown in FIG. 4, the locking dogs 201 engage into the locking profile 301 and retains the plug 300 in the shown position. Although not shown in FIG. 4, another plug could be set in the first locking assembly 100. The plug 300 has a sealing apparatus 309 which is configured to seal against the spool bore 9 of the adapter spool 1. The sealing apparatus 309 can typically be a metal-to-metal type seal.

As now will be appreciated by the person skilled in the art, the plug 300 does not need to comprise an integrated locking mechanism in order to be set in the spool bore 9 of the adapter spool 1. The plug 300 therefore offers more available space for functional features such as feedthroughs or a large through bore. Since the locking assembly 100, 200 is operated from outside the adapter spool 1, such as with a remotely operated vehicle (ROV) (not shown in the drawings), the plug running tool does not require a plug setting/locking mechanism. The supply of pressurized hydraulic fluid to the hydraulic locking channel 111, unlocking channel 113 and the secondary unlocking channel 117, can be accomplished in various manners, as will be appreciated by the skilled person. For example, one may use a control module to control a set of accumulators containing pressurized hydraulic fluid. Alternatively, an ROV (remotely operated vehicle) may connect directly to hot stab interfaces associated with the hydraulic channels.

At a lower portion of the plug 300, it may comprise a power cable interface 315, configured to connect to a power cable. Such a cable can for instance be a submersible pump power cable.

Figure 5:
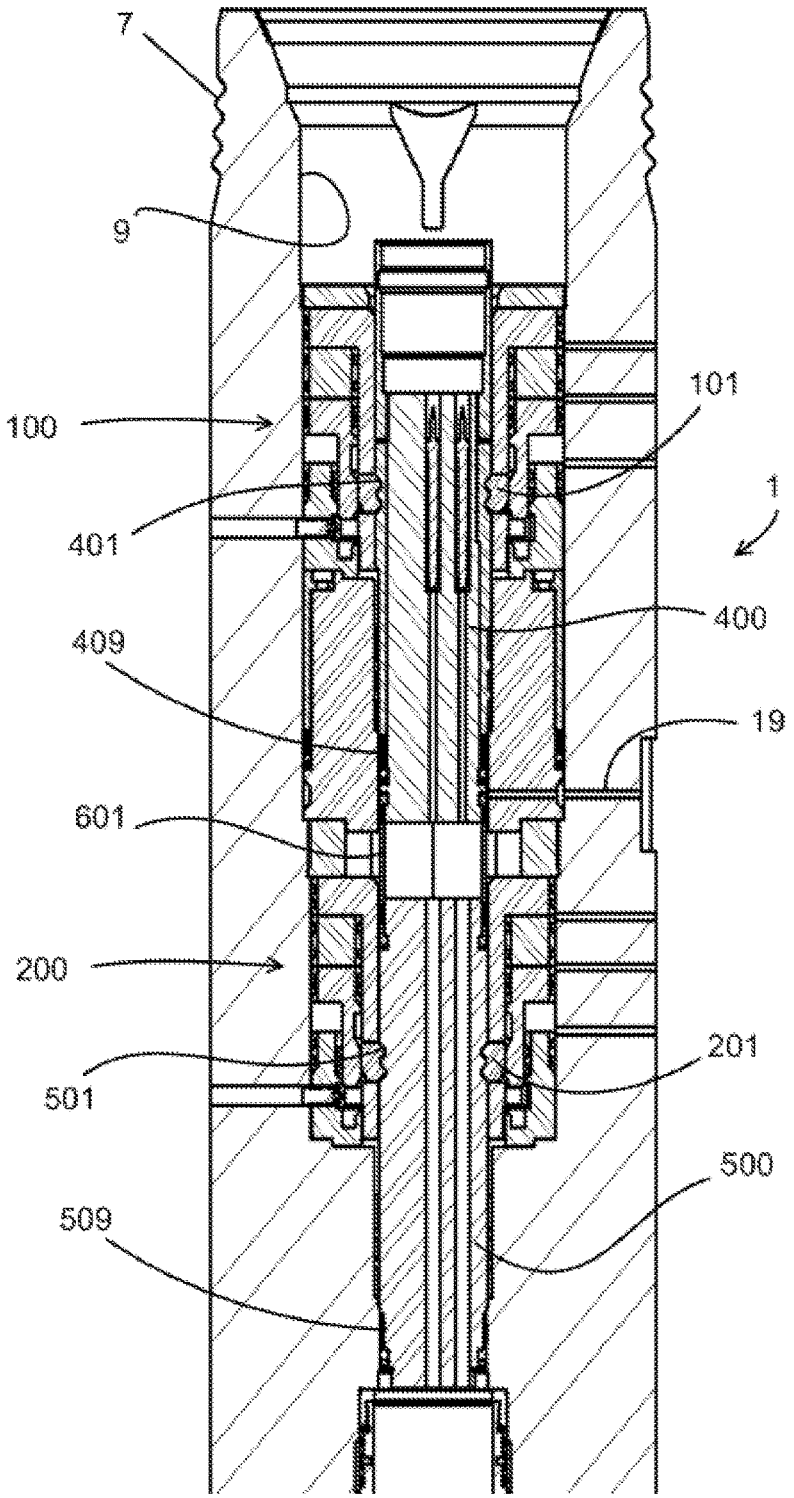
FIG. 5 is a cross section side view corresponding to FIG. 3, however, with a plug assembly according to the present invention installed.

FIG. 5 shows another cross section view through the adapter spool 1 shown in FIGS. 3 and 4. In this embodiment, a plug assembly 600 is installed and locked within the bore 9 of the adapter spool 1. The plug assembly 600 comprises a first plug 400 and a second plug 500. The first plug 400 is locked with the first locking assembly 100, while the second plug 500 is locked with the second locking assembly 200. The first plug 400 is attached to the second plug 500 with an intermediate coupling 601, here in the form of an intermediate sleeve (see also FIG. 6). Thus, when lowering the plug assembly 600 from a surface location towards the adapter spool 1 at the seabed location, both plugs 400, 500 are run simultaneously. That is, two plugs are set in the spool bore 9 in one single run.

Figure 6:
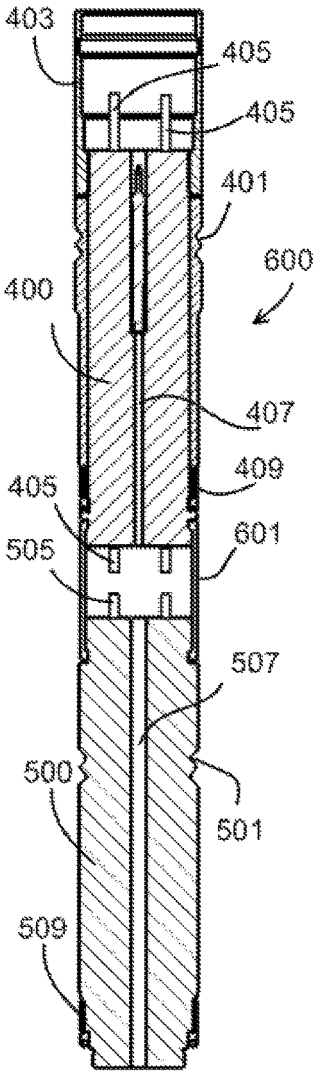
FIG. 6 is a cross section view of a plug assembly according to the present invention.

FIG. 6 illustrates the plug assembly 600 in a separate cross section side view. The first and second plugs 400, 500 have a locking profile 401, 501 adapted to engage the first and second locking assembly 100, 200 discussed above. At an upper portion of the first plug 400, there is a running tool interface 403 which is adapted to be releasably engaged by a plug running tool. Also visible on the first plug 400 are hydraulic and/or electric penetrators 405. The second plug 500 may also comprise such penetrators (shown in FIG. 6).

Both plugs 400, 500 comprise a through bore 407, 507 which are adapted for a feedthrough (not shown in the drawings). Such a feedthrough may typically be a high power electrical feedthrough for providing electric power to an ESP.

In the position of the intermediate coupling 601, a (not shown) communication between the penetrators 405, 505 can be provided, thereby connecting, for example, electric signaling between the two plugs 400, 500.

Figure 7:
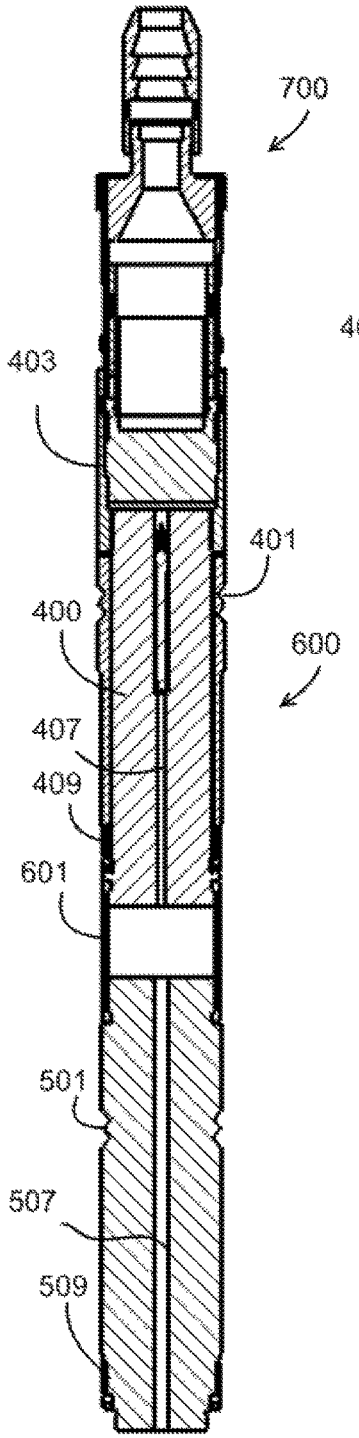
FIG. 7 is a cross section view of the plug assembly shown in FIG. 6, however, with a plug running tool engaged to its upper portion.

FIG. 7 illustrates the same plug assembly 600 as in FIG. 6, however, connected to a plug running tool 700. The plug running tool 700 comprises at its upper portion a coil tubing connector 701. The plug running tool 700 also has a plug interface adapted to lock to the running tool interface 403 of the plug assembly 600 in a releasable manner. It is notable that the running tool 700 does not comprise a plug locking mechanism adapted for locking a plug to a bore.

Figure 8:
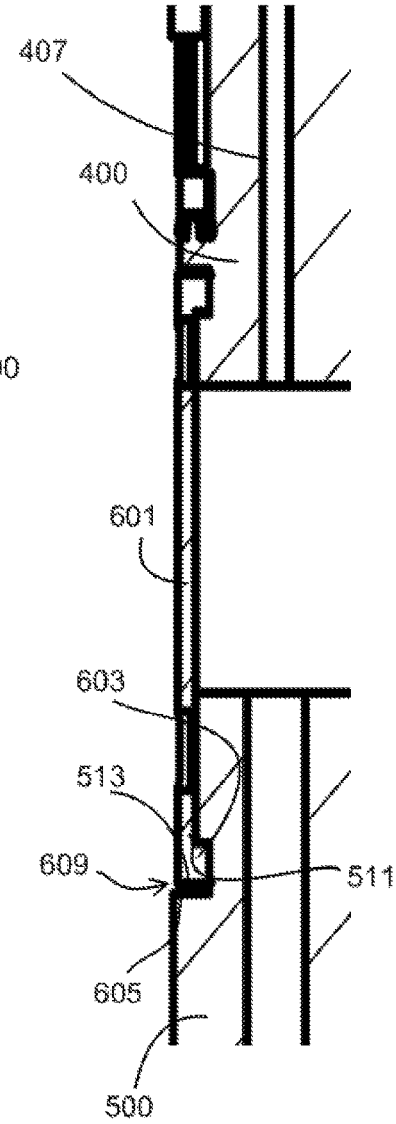
FIG. 8 is an enlarged cross section view of a part of the plug assembly shown in FIGS. 6 and 7.

FIG. 8 is an enlarged portion of the cross section view shown in FIG. 6, illustrating the interface between the intermediate coupling 601 and the first and second plugs 400, 500, respectively. In order to let the plugs 400, 500 align to their correct installed positions, they must be able to move somewhat with respect to each other. For example, after landing the plug assembly 600, the lowermost plug 500 may first be locked to the spool bore 9 via the second locking assembly 200. Then, when locking the uppermost first plug 400, this plug must be able to align itself into the correct locked position when actuating the first locking assembly 100. Such alignment of the plugs 400, 500 may be crucial for obtaining proper sealing with the plug seals 409, 509.

Still referring to FIG. 8, the intermediate coupling 601 is in this embodiment designed as a sleeve. At a lower end, it has an inwardly extending shoulder 603 that engages a lifting shoulder 511 of the main body of the second plug 500. The sleeve and its shoulder 603 also has a lower face 605. Below and facing the lower face 605, the second plug 500 has a landing shoulder 513. When the (lower) second plug 500 hangs down from the intermediate coupling 601, there is a gap 609 between the landing shoulder 513 and the lower face 605. When the (lower) second plug 500 lands within the spool bore 9, however, this gap 609 is closed or reduced. The first and second plugs 400, 500 are therefore configured to move axially with respect to each other.

Although the intermediate coupling 601 in the shown embodiment is designed as a sleeve connecting the first and second plugs 400, 500, it could have a significant different structure. For instance, it could be a flexible wire or an articulated chain connecting the first and second plugs 400, 500. Advantageously, as will become clear from the description further below, the intermediate coupling 601 should be designed to carry the weight of a submersible pump which is connected to the plug assembly 600 with a power cable.

Figure 9:
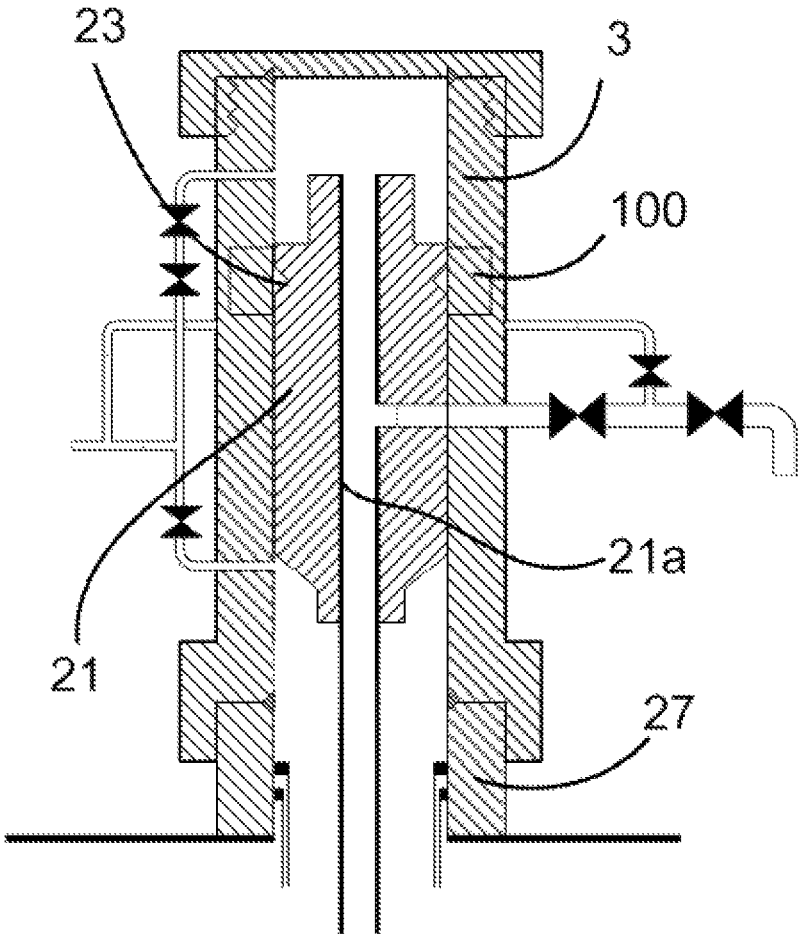
FIG. 9 is a principle view of a subsea well assembly according to the present invention comprising a locking assembly in a Xmas tree spool.
Figure 10:
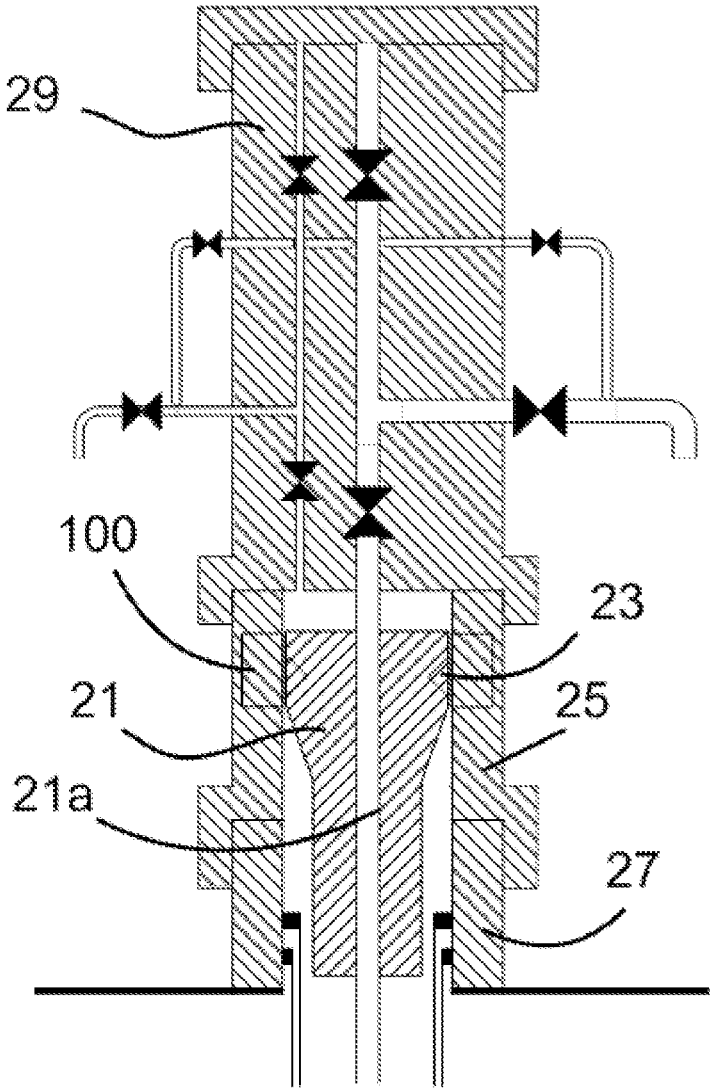
FIG. 10 is another principle view of a subsea well assembly according to the present invention comprising a locking assembly in a tubing head spool.

FIGS. 9 and 10 are schematic illustrations of another application of a locking assembly 100, such as the first locking assembly shown in FIG. 3. In the embodiment shown in FIG. 9, a locking assembly 100 is arranged within the spool of a Xmas tree 3, which in this embodiment is a horizontal Xmas tree (HXT). A tubing hanger 21 is landed inside the spool of the HXT 3. The tubing hanger 21 is provided with a tubing hanger locking profile 23. After landing the tubing hanger 21 within the spool of the HXT 3, the locking assembly 100 engages the tubing hanger locking profile 23 and locks the tubing hanger 21 in place. Above the HXT 3, there could be an adapter spool 1, corresponding to the solution shown in FIG. 1. Within the adapter spool 1, there could be a single plug 300 or a plug assembly 600 having two plugs 400, 500.

The tubing hanger 21 has a main bore 21*a* which in some embodiments may comprise a locking assembly 100 (not shown, however, in FIG. 9).

FIG. 10 schematically illustrates a similar embodiment, wherein a tubing hanger 21 is landed in a tubing head spool 25. The tubing head spool 25 is arranged between a wellhead spool 27 and a vertical Xmas tree (VXT) 29. A locking assembly 100, corresponding to the first locking assembly 100 discussed above, is arranged within the bore of the tubing head spool 25. The locking assembly 100 engages the tubing hanger locking profile 23 of the tubing hanger 21, thereby locking the tubing hanger 21 within the tubing head spool 25.

As will be appreciated by the person skilled in the art, with the embodiments shown in FIGS. 9 and 10, the tubing hanger 21 does not need to be provided with a locking mechanism. The tubing hanger 21 merely needs the locking profile 23, which can be one or more passive recesses. More space is therefore available in the tubing hanger 21 for various functionality. The tubing hanger running tool (not shown in the drawings) also does not need to be provided with a tubing hanger locking functionality in order to lock the tubing hanger 21 in place. As discussed above, the locking assembly 100 can be actuated, for example, with hydraulic pressure supplied from an ROV or another source.

Reverting to view of FIG. 3, the locking mechanisms 100, 200 are also provided with an orientation device 119, 219. The orientation device 119, 219 can engage the tubing hanger 21 when landing to rotate the plugs or the tubing hanger 21 into a known/predetermined rotational position.

The tubing hanger 21 shown in FIG. 10 has a main bore 21*a* which in some embodiments may comprise a locking assembly 100 (not shown, however, in FIG. 9).

Figure 11:
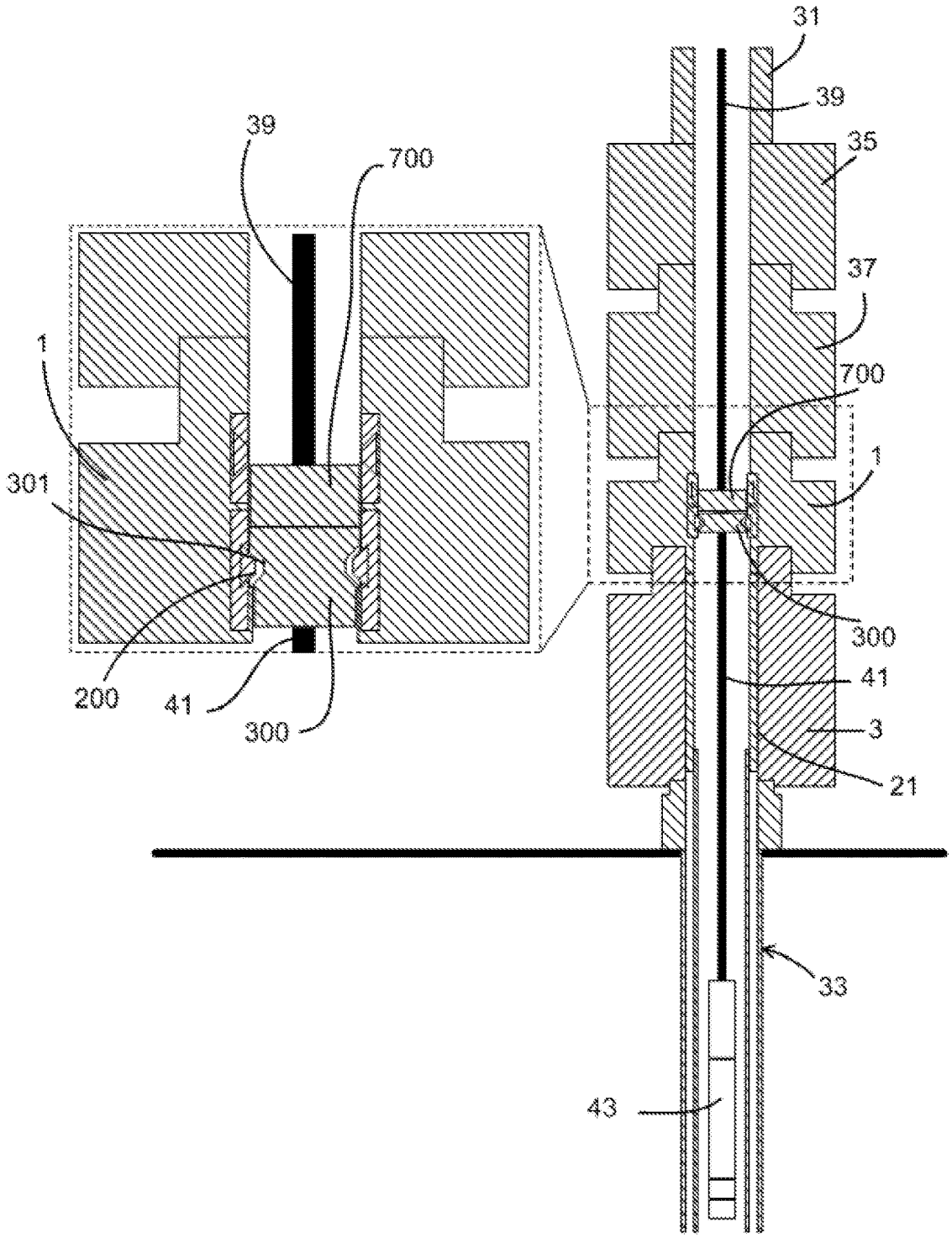
FIG. 11 is a principle diagram showing a possible setup of a subsea well arrangement according to the present invention.

FIG. 11 is a setup of a subsea well arrangement, wherein a workover riser string 31 extends between a surface installation (not shown) and the top of a subsea well 33. The workover riser string 31 connects to a stack comprising an EDP 35, a LRP 37, the adapter spool 1, and the Xmas tree 3. From the surface installation, a coiled tubing 39 is lowered through the workover riser 31. At the end of the coiled tubing 39 is a plug running tool 700, which is locked to a plug 300. The plug 300 is landed in the adapter spool 1 and locked with a locking assembly 200 in the adapter spool 1. The locking assembly 200 can be operated with an ROV.

Extending down from the plug 300 is an ESP power cable 41. The ESP power cable 41 connects to an ESP 43 located downhole. Instead of an electric pump, one could also use a hydraulic submersible pump powered by hydraulic fluid through a power cable connected to the plug 300.

Figure 12:
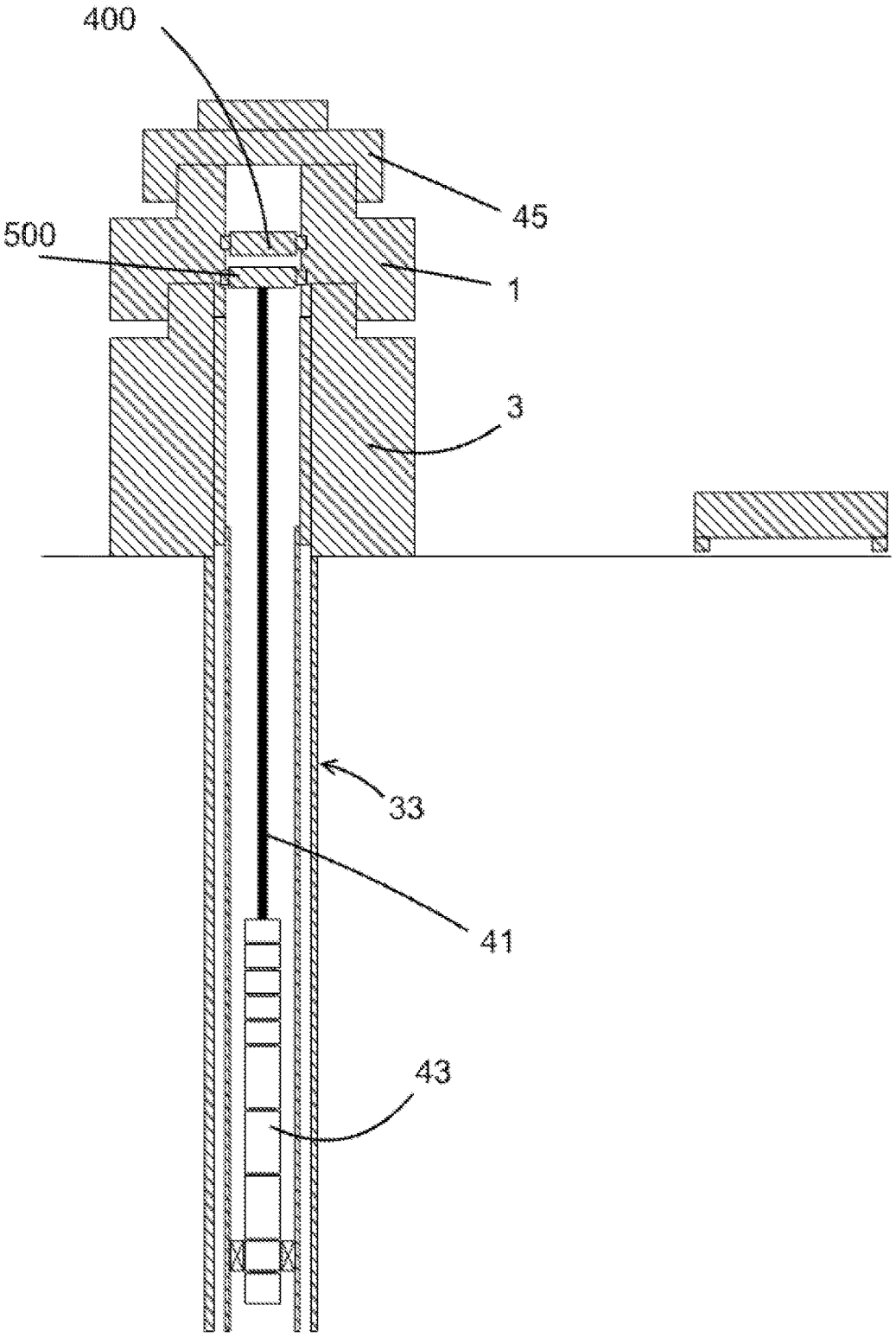
FIG. 12 is the setup corresponding to FIG. 11 after installation.

When the plug 300 and the ESP 43 are installed, and the installation is tested, the workover riser string 31, EDP 35, and LRP 37 are removed. An adapter spool cap 45 is locked to the upper interface 7 of the spool adapter 1, as shown in FIG. 12 (compare to FIG. 2 to see the upper interface 7 of the spool adapter). While only one plug 300 was installed in the embodiment shown in FIG. 11, the embodiment shown in FIG. 12 involves two plugs, for example, the two plugs of the plug assembly 600 discussed above. When two plugs are installed, the adapter spool cap 45 will not need to constitute a pressure barrier.

Figure 13:
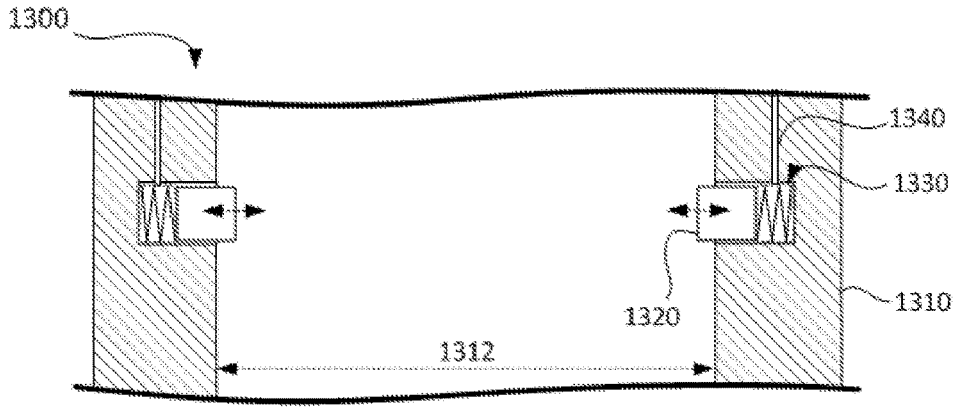
FIG. 13 illustrates two representative embodiments (A and B) of a locking tube.
Figure 13:
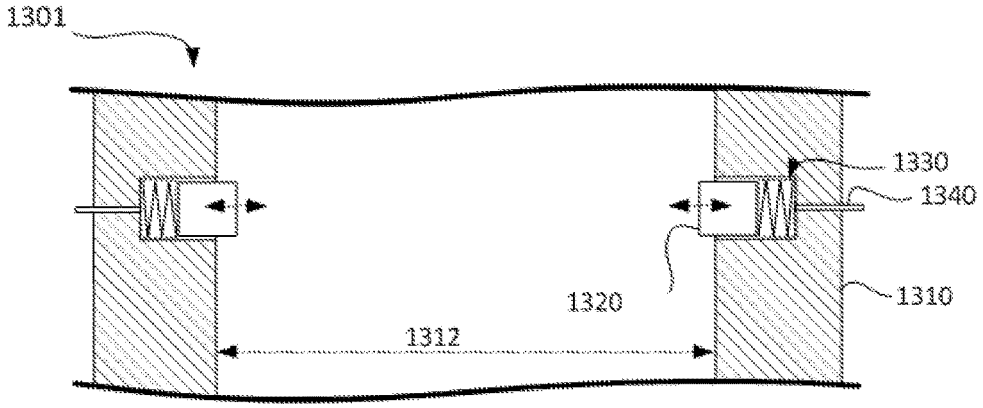

To provide electric power to the ESP 43 in the setup shown in FIG. 13, a wet-mate connection (not shown) fixed to the adapter spool cap 45 may connect to a counterpart (not shown) on the upper plug 400. Electric power may then be guided through the feedthroughs of the upper and lower plugs 400, 500.

While the first and second locking assemblies 100, 200 discussed above are shown as installed within the adapter spool 1, one or more of such locking assemblies may be arranged within the spool of a subsea Xmas tree or even within the bore of a tubing hanger. It or they may also be arranged within a tubing head spool, such as arranged between a subsea wellhead spool and a vertical Xmas tree. It is also possible to provide the bore of a wellhead spool with such a locking assembly or assemblies.

In the discussed embodiments above, reference is made to subsea well equipment, such as a subsea Xmas trees and a subsea tubing hanger. It is, however, noted that the equipment discussed will also be applicable to onshore, subterranean wells, as will be appreciated by the skilled person.

FIG. 13 illustrates representative embodiments (A and B) of a locking tube. Locking tube 1300, 1301 may have an inner dimension (for example, an inner diameter) 1312 sized to receive a lockable insert. One or more movable "dogs" may be coupled to a tube body 1310 via one or more actuators 1330. The actuators 1330 may be controlled by one or more control channels 1340 to actuate (for example, roll, slide, move, and the like) the movable dogs. FIG. 13 A illustrates an embodiment in which a control channel provides communication between the actuator and a top of the locking tube. FIG. 13 B illustrates an embodiment in which a control channel provides communication between the actuator and a side of the locking tube.

In some embodiments, a movable dog is actuated inwards to lock a lockable insert and outward to unlock the insert. A dog may be actuated outward to lock the insert. A dog may be actuated vertically, horizontally, tangentially, radially, and the like. A dog may typically be actuated at least between an unlocked position (for example, where it does not extend into the bore) and a locked position (where it extends into the bore).

Figure 14:
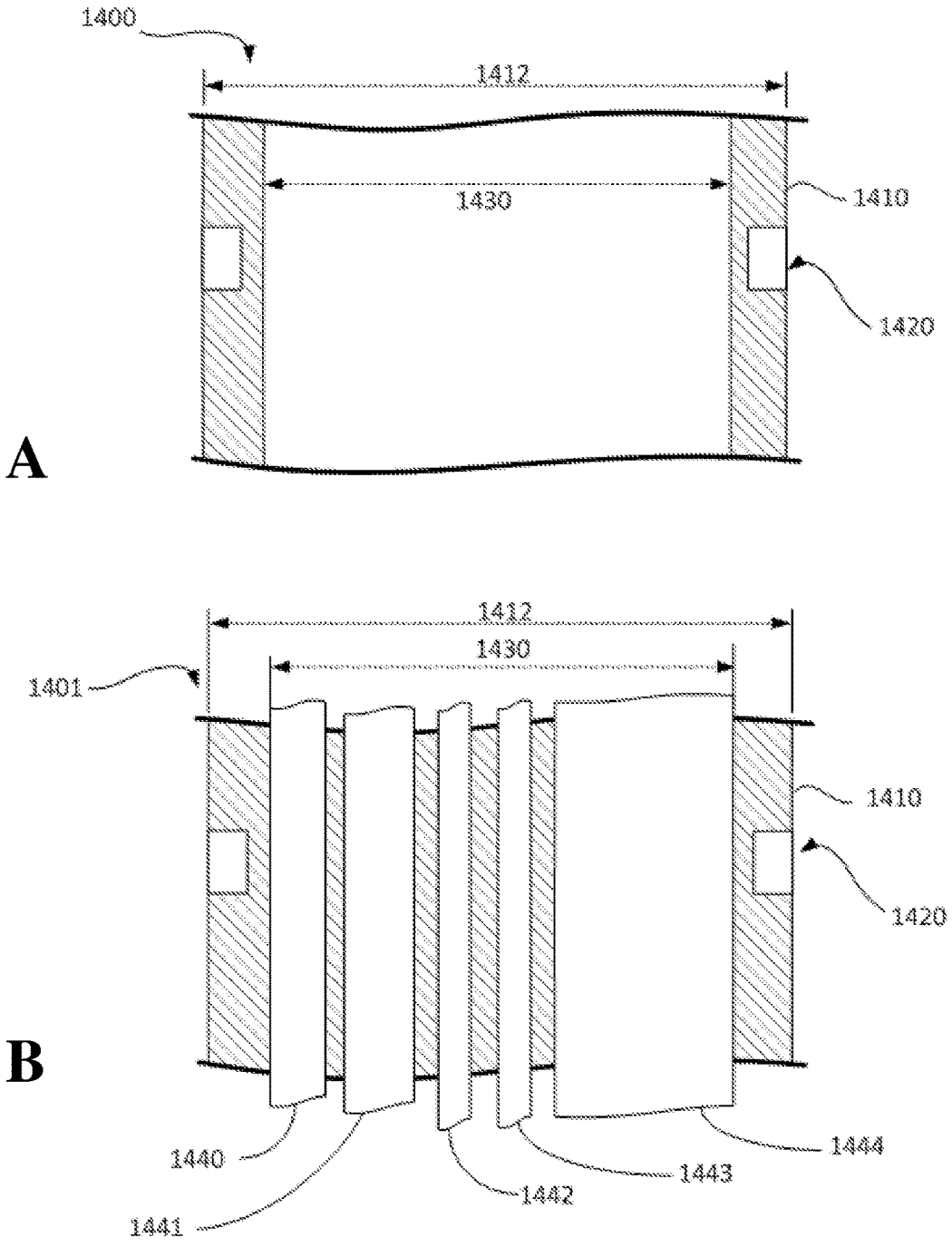
FIG. 14 illustrates two embodiments (A and B) of a lockable insert.

A dog may comprise a face that is shaped (for example, chamfered, spherical, pyramidal, trapezoidal, and the like). The shape of the dog is typically matched to correspond to (for example, to fit snugly within) a shape of a corresponding recess of a lockable insert (FIGS. 14 A and B).

An actuator may comprise a hydraulic actuator (for example, a piston), an electric actuator (for example, a lead screw, a solenoid, and the like), a piezoelectric actuator, a magnetic actuator, and the like.

A control channel may be suitably matched to control and/or provide actuation energy to the actuator. The control channel may comprise a hydraulic line, an electrical line, an optical line, an acoustic line, a mechanical coupling (for example, a linkage) and the like. A control channel may comprise a digital (for example, wireless) communication link (for example, 802.11, 802.16, CDMA, GSM, Edge, and the like). A control channel may comprise a first channel that controls the actuator and a second channel that provides actuation power to the actuator.

A dog may typically be disposed toward an interior of the tube body 1310, and the associated actuator may be controlled via a control channel that provides communication to an exterior of the tube body (for example, to a top, a side, and/or a bottom). A control channel may be controlled by a fixed device to which it is coupled (e.g., a christmas tree). A control channel may be controlled by a remote device (for example, a remote operated vehicle, ROV).

In an embodiment, a locking tube comprises an adapter spool configured to couple to (for example, to land on) a christmas tree (for example, a subsea tree, such as a horizontal tree, a vertical tree, and the like). A locking tube may comprise a tubing hanger (for example, a production tubing hanger), a wellhead, a spool (for example, a tubing spool) and the like. A locking tube may comprise a connector configured to connect two pipes.

FIG. 14 illustrates certain embodiments (A and B) of a lockable insert. A lockable insert 1400, 1401 may have an outer dimension (for example, an outer diameter) 1412 shaped to removably fit into an inner dimension 1312 of a corresponding locking tube. A locking tube and lockable insert may be combined to form a locking assembly.

The lockable insert may comprise an insert body 1410 of dimensions and materials suitable for the mechanical, fluidic, hydraulic, electrical, corrosion, and/or other requirements.

A lockable insert may comprise one or more recesses 1420 shaped to receive a corresponding movable dog (for example, from a locking tube). A recess may comprise a discrete divot. A recess may comprise a groove.

A portion of the insert body 1410 (for example, an outer portion) may be associated with providing locking functionality. An access distance 1430 (for example, a diameter or a plurality of dimensions) may describe a portion of the insert that may be used for other functions. An access distance may comprise a bore through which fluid may flow. An access diameter may comprise one or more feedthroughs, penetrators, and the like, such as an electrical, hydraulic, mechanical, acoustic, optical, or fluidic penetrator. Penetrators 1440, 1441, 1442, 1443 and 1555 are shown in FIG. 14 B. In an embodiment, an insert body comprises an electrical penetrator configured to couple to, suspend, and control an ESP (for example, via a tubing/coil). An access distance may be at least 70%, including at least 80%, including at least 90% of an outer distance (for example, an outer diameter) of the lockable insert.

Figure 15:
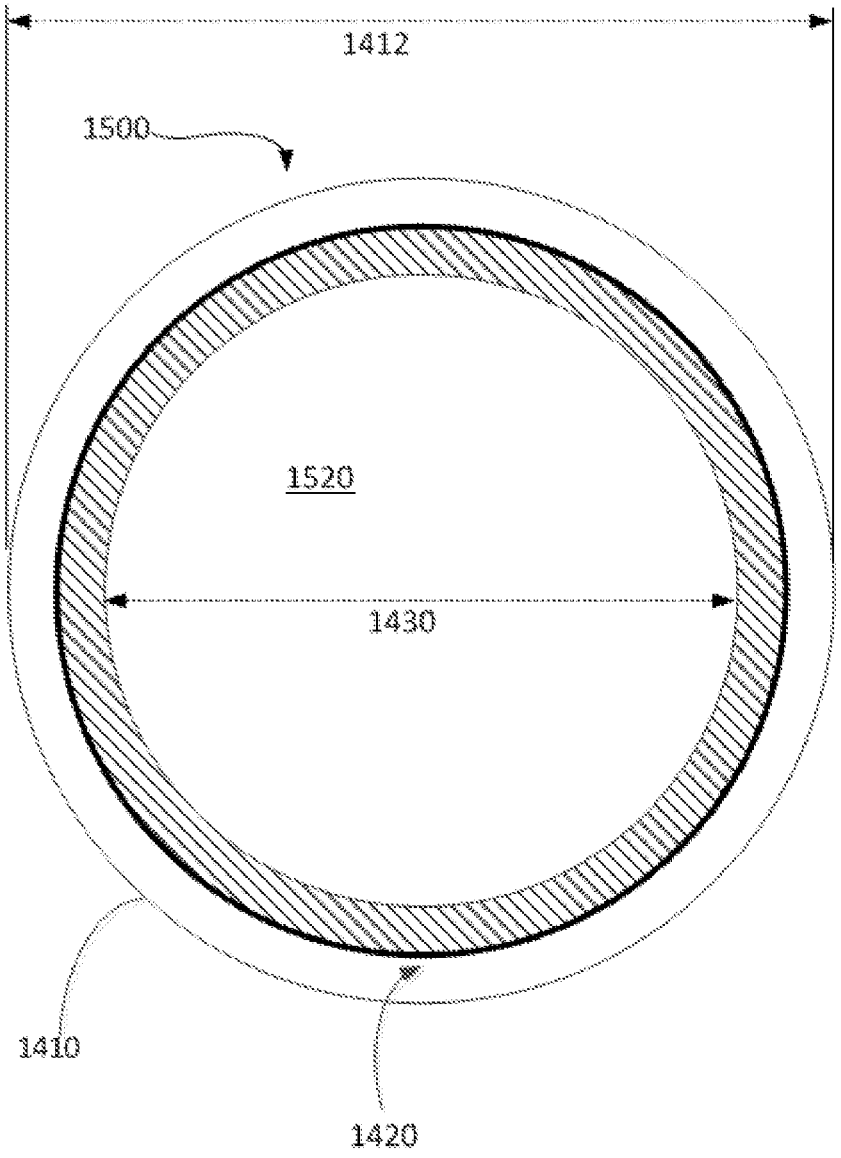
FIG. 15 illustrates an access area.

FIG. 15 illustrates an access area according to some embodiments. A lockable insert may comprise a first cross sectional area 1500 of substantially the entire insert. The first cross sectional area may include a portion devoted toward providing locking functionality. In FIG. 15, the depth of recess 1420 and an appropriate portion of solid material (for example, according to mechanical requirements) may be reserved for "locking functionality."

A remaining portion of a lockable insert that may be used for functions other than locking may be described by an access area 1520. An access area 1520 may be substantially circular. An access area 1520 may be characterized by one or more dimensions 1430 according to its complexity. An access area 1520 may have a more complicated shape (for example, have a plurality of curvatures around discrete recesses 1420). An access area 1520 may be greater than 60%, including greater than 70%, including greater than 80%, including greater than 90% of the first cross sectional area 1500 of the insert.

By locating the actuators and/or locking dogs with the locking tube, an access diameter (and corresponding access area) may be significantly increased. Various embodiments are directed toward providing a locking assembly that removably isolates an interior of a tube (or other enclosed volume) from the exterior via the lockable insert. The insert may seal the interior from the exterior. The insert may prevent passage of a first material (for example, production fluids) and provide for communication of a second material (for example, hydraulic control fluids). The insert may seal the tube and provide for power and/or communication between the exterior and interior of the tube.

In some embodiments, this provision (for example, of power) may be limited by the access area. By increasing the access area (for example, for an electrical penetrator), a larger penetrator (for example, a bigger cable) may be implemented which may increase the power capacity delivered through the insert. As a result, a device requiring this power (for example, a downhole ESP) may be sized to take advantage of the increased power delivery capacity.

An increased access area may be used to provide an increased bore size through the insert. An increased bore size (at a given outer diameter) may increase flow rates through the insert, which may increase the ratio of the inner diameter of the bore as compared to the outer diameter of the insert, and by extension, the inner diameter of the locking tube within which the insert is locked.

Figure 16:
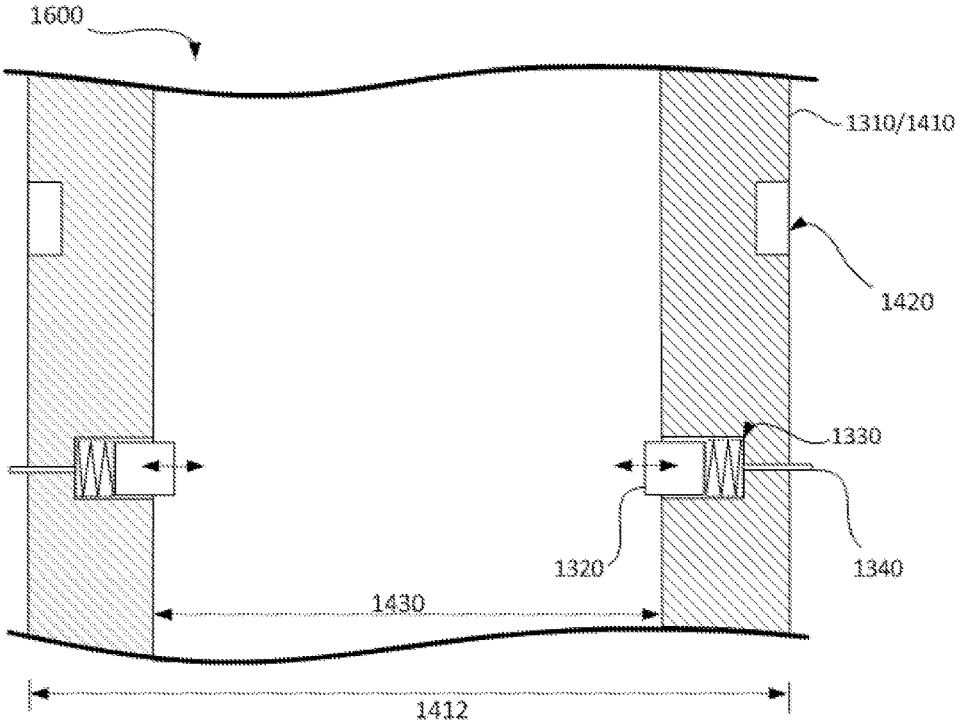
FIG. 16 illustrates a locking component comprising a combination of locking tube and lockable insert features.

FIG. 16 illustrates a locking component comprising a combination of locking tube and lockable insert features, according to some embodiments. A first lockable insert may itself incorporate a locking tube configured to lock a second lockable insert. In FIG. 16, locking component 1600 comprises a body 1310/1410 having an exterior dimension 1412 (for example, an outer diameter) sized to fit into a first "outer" locking tube. One or more recesses into an exterior surface of the body (for example, radially inward from a side) may be shaped to be locked by corresponding movable dogs actuated via the first locking tube (not shown).

Body 1310/1410 may comprise one or more of its own movable dogs 1320 and corresponding actuator(s) 1330 and control channel(s) 1340, and have its own inner dimension 1430 (for example, an inner diameter) sized to receive a corresponding second "inner" locking insert. In some implementations, locking component 1600 may comprise a tubing hanger. Locking component 1600 may comprise a connector configured to connect a first pipe or tube to a second pipe or tube. A control channel of an inner locking tube may be coupled to a control channel of the outer locking tube. A control channel of the inner locking tube may communicate with an exterior of an assembly incorporating the locking component.

Various aspects described herein may be implemented together and/or separately. An explicit combination of features does not preclude the implementation of these features separately. Various combinations of features may be implemented, notwithstanding that the illustrative embodiments described herein may not explicitly recite a particular combination. Reference should also be had to the appended claims.

What is claimed is:

1. A well tube configured for use with a subsea well assembly which comprises a Christmas tree arranged on top of a subterranean well, the well tube comprising:

a bore comprising a first plug receiving space and a second plug receiving space arranged therein;

a first locking assembly arranged in the first plug receiving space, the first locking assembly comprising:

a first locking dog configured to move into and out of the bore, a first actuator configured to move the first locking dog, and a first control channel configured to couple the first actuator to an exterior of the well tube and to control the actuator so as to move the first locking dog;

a second locking assembly arranged in the second plug receiving space, the second locking assembly comprising:

a second locking dog configured to move into and out of the bore, a second actuator configured to move the second locking dog, and a second control channel configured to couple the second actuator to the exterior of the well tube and to control the second actuator so as to move the second locking dog;

a lockable insert which comprises an insert body comprising an outer body, and a fixed recess arranged on an outer surface of the insert body, the insert body comprising a plug which is configured to seal the bore; and at least one penetrator arranged through the insert body, the at least one penetrator being configured to provide for at least one of an electrical communication, an electronic communication, a fluidic communication, an acoustic communication, a magnetic communication, an optical communication, and a mechanical communication between a first surface of the insert body and a second surface of the insert body which opposes the first surface.

2. The well tube as recited in claim 1, wherein, the bore is configured to extend between an upper bore end and a lower bore end, and the first locking dog, the second locking dog, the first actuator and the second actuator are each arranged between the upper bore end and the lower bore end.

3. The well tube as recited in claim 1, wherein the well tube further comprises a Christmas tree.

4. The well tube as recited in claim 1, wherein the well tube further comprises:

an adaptor spool comprising a lower interface which is configured to lock onto an upper interface of a Christmas tree.

5. The well tube of as recited in claim 1, wherein the at least one penetrator comprises a power cable interface configured to connect to a power cable which is configured to at least one of suspend power to and provide power to an electrical submersible pump.

6. The well tube as recited in claim 5, further comprising:

the electrical submersible pump coupled to the plug via the power cable interface.

7. The well tube as recited in claim 4, wherein the well tube further comprises:

an upper interface which resembles or is identical to an upper profile of the Christmas tree.

8. The well tube as recited in claim 1, wherein the well tube further comprises:

at least one coupling and/or spacer configured to be interposed between the first locking assembly and the second locking assembly.

9. A hydrocarbon production assembly comprising:

a well tube comprising, a bore comprising a first plug receiving space and a second plug receiving space arranged therein, a first locking assembly arranged in the first plug receiving space, the first locking assembly comprising:

a first locking dog configured to move into and out of the bore, a first actuator configured to move the first locking dog, and a first control channel configured to couple the first actuator to an exterior of the well tube and to control the actuator so as to move the first locking dog, and a second locking assembly arranged in the second plug receiving space, the second locking assembly comprising:

a second locking dog configured to move into and out of the bore, a second actuator configured to move the second locking dog, and a second control channel configured to couple the second actuator to the exterior of the well tube and to control the second actuator so as to move the second locking dog;

a Christmas tree;

a lockable well bore insert configured to be locked in the bore of the well tube, the lockable well bore insert comprising an insert body and a fixed locking recess arranged into an outer surface of the insert body;

an electrical penetrator arranged through the lockable well bore insert;

a pump power cable connected to the electrical penetrator; and an electrical submersible pump coupled to the lockable well bore insert via the pump power cable.

10. The hydrocarbon production assembly as recited in claim 9, further comprising:

a plug comprising a plug body and a fixed locking recess which is arranged into an outer surface of the plug body, the plug body being locked in the second plug receiving space.

11. A lockable well bore insert configured to be locked in a bore of a well tube configured for use with a subsea well assembly comprising a Christmas tree, the lockable well bore insert comprising:

an upper main body comprising a first outer diameter and a first recess into a surface of the upper main body;

a lower main body comprising a second outer diameter and a second recess into a surface of the lower main body, the lower main body being directly or indirectly attached to the upper main body;

an electrical penetrator arranged on each of the upper main body and on the lower main body, each electrical penetrator being configured to connect to a pump power cable, wherein, the lockable well bore insert is coupled to the pump power cable, and an electrical submersible pump is coupled to the lockable well bore insert via the pump power cable.

12. The lockable well bore insert as recited in claim 11, further comprising:

a feedthrough configured to extend from an upper interface to a lower interface, the feedthrough comprising at least one of a mechanical penetrator, a hydraulic penetrator, an electrical penetrator, an optical penetrator, and a communications penetrator.

13. The lockable well bore insert as recited in claim 11, wherein the upper main body and the lower main body each comprise a sealing apparatus.

14. The lockable well bore insert as recited in claim 11, wherein the upper main body is coupled to the lower main body via an intermediate coupling.

15. The lockable well bore insert as recited in claim 14, wherein the intermediate coupling is configured to provide for an independent movement of the upper main body with respect to the lower main body.

* * * * *